US006073417A

United States Patent [19]

Hackett

[11] Patent Number: 6,073,417

[45] Date of Patent: Jun. 13, 2000

[54] BUILDING SYSTEM

[75] Inventor: Kenneth Paul Hackett, Hendersonville, Tenn.

[73] Assignee: Pleasant Shade Investments, Inc., Waynesboro, Tenn.

[21] Appl. No.: 09/006,614

[22] Filed: Jan. 13, 1998

Related U.S. Application Data

[63] Continuation-in-part of application No. 08/443,075, May 17, 1995.

[51] Int. Cl.[7] ..... E04G 21/14; E04B 2/58

[52] U.S. Cl. ..... 52/745.09; 52/167.3; 52/298; 52/265; 52/662; 52/664; 403/347

[58] Field of Search ..... 52/262, 264, 274, 52/295, 296, 298, 662, 664, 666, 667, 656.1, 653.1, 653.2, 745.05, 745.09, 745.1, 167.3; 403/346, 347, 400; 29/897.15, 897.31, 897.32

[56] References Cited

U.S. PATENT DOCUMENTS

| | | |
|---|---|---|
| 1,581,487 | 4/1926 | Kohler . |
| 2,001,215 | 5/1935 | Ruppel . |
| 2,976,968 | 3/1961 | Fentiman . |
| 3,690,078 | 9/1972 | Maynard, Jr. . |
| 3,849,013 | 11/1974 | Bibb . |
| 3,925,942 | 12/1975 | Hemmelsbach . |
| 4,179,858 | 12/1979 | Graham et al. . |
| 4,221,038 | 9/1980 | Singer et al. . |
| 4,466,600 | 8/1984 | Tuttle . |
| 5,218,809 | 6/1993 | Baumann . |
| 5,251,420 | 10/1993 | Johnson . |

*Primary Examiner*—Michael Safavi
*Attorney, Agent, or Firm*—W. Allen Marcontell

[57] ABSTRACT

Load bearing panels and walls for habitable shelters are formed from relatively thin wall metallic tubing on widely spaced centers joined by a multiplicity of joint systems including shrink fit lap splicing, detent forming at standardized positional increments and frictional heat dissipation. The metallic tubing is arranged in rows along a line as well as intersecting rows along a second perpendicular line so as to form a load bearing panel with rows of tubes lying in a single plane. Tubing elements of one row intersecting and secured to the tubing elements of the second row without mechanical fasteners. Discreet interference fit tolerances facilitate the construction of a non-welded, stress distributing structure highly suitable for earthquake resistance and wildfire survival.

25 Claims, 7 Drawing Sheets

BUILDING SYSTEM

CROSS-REFERENCE TO RELATED APPLICATION

This application is a continuation-in-part of pending application Ser. No. 08/443,075 filed May 17, 1995.

BACKGROUND OF THE INVENTION

The present invention relates to systems an articles for assembling structural framing components. More particularly, the invention pertains to methods and apparatus for erecting habitable structures.

Western construction methods are not particularly tolerant of seismic vibration. These methods are characterized by assemblies of rigid but friable materials such as brick, stone and mortar. Although modern commercial construction usually relies upon a steel superstructure that is paneled with masonry and plaster, the steel load bearers are heavily stressed and joined by welded or riveted shear joints. When whipped by the high amplitude, low frequency ground movement of a seismic disruption, welds are broken and rivets are sheared and the steel superstructure collapses.

Others have observed that construction methods and materials used by native cultures of the Pacific Rim are very earthquake tolerant. Significant characteristics of this technology include the use of wood and bamboo assembled by leather thongs, grass and leaves. Timbers are joined without nails or pegs. Rather than rupture, such joints merely slip in their lashings or sockets.

Although primitive construction methods and materials may be earthquake survivable, they also are not particularly fire or rot resistant. Neither are such construction methods particularly weathertight, draft resistant or suitable for multistory structures.

However, the central essence of these earthquake resistant construction methods is not so much in the indigenous materials used but in the absence of rigidly joined points of high load and stress concentration. It is in the capacity of the structural joints to yield, slip and twist without stressing the fasteners or load bearers beyond the point of failure that distinguishes the primitive Pacific construction methods for being earthquake proof.

It is, therefore, an object of the present invention to provide some construction assembly techniques that adapt the primitive low stress joint technology to modern, high strength materials.

Another object of the present invention is to provide methods and apparatus for erecting habitable structures with ferrous, non-ferrous metallic or plastic tube but without welding or threaded fasteners.

SUMMARY OF THE INVENTION

These and other objects of the invention are accomplished by a habitable structure construction system of thin-wall tubing wherein load bearing walls are formed as a woven matrix of tubing having socket intersections. Joist and sill joints are formed by interference fitting socket joints. Habitable structures may include residential dwelling, both foundation secured and mobile, truck bodies and agriculture out-buildings such as barns.

Collectively, the structure is assembled with the strength and compliance of a woven wire cage or basket wherein dynamic loads are adsorbed as frictional heat and spring stress. Standardized blocks, preferably of a ferrous material, are bored along mutually perpendicular axes to receive the end of a joint pin. The internal diameter dimensions of the joint block bores are formed smaller than the outside diameter of respective pins. A joint is made by heating or cooling one member of the joint and quickly inserting one joint element coaxially within the other.

Alternatively, the pin surfaces and block bores may be turned to low, 5% or less, taper angles and driven together with shock force.

Continuous length tube elements are formed similarly by joining short lengths of tubing with an internal tubular lap splice. Such internal lap splice tubes correspond to the pins that are joined in the bores of corner blocks.

Biased frictional joints in a load bearing wall matrix socket together with uniformly spaced, oppositely facing saddles formed along a tube length. Sloping sides to the joint saddles and the resilient properties of steel tubing bias the saddle bights back together when displaced by a high amplitude shock wave.

BRIEF DESCRIPTION OF THE DRAWINGS

The preferred embodiments of the invention are described in further detail with reference to the drawings wherein.

DESCRIPTION OF THE PREFERRED EMBODIMENTS

Figure 1:
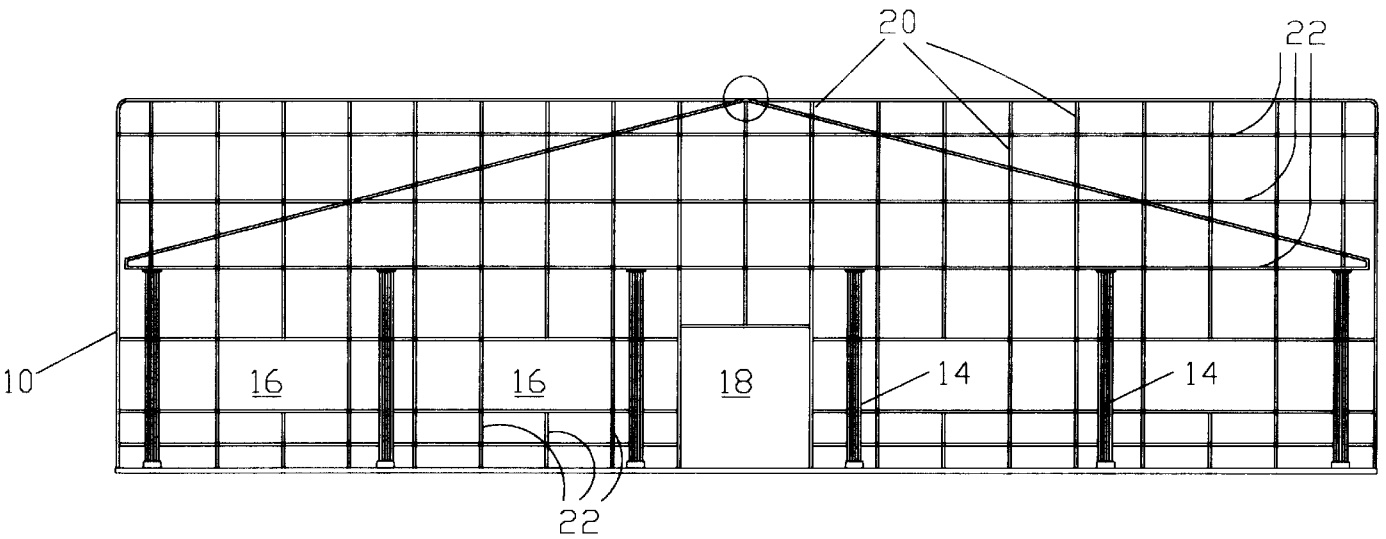
FIG. 1 is a front elevation of a rectangular structure constructed according to the present invention.
Figure 2:
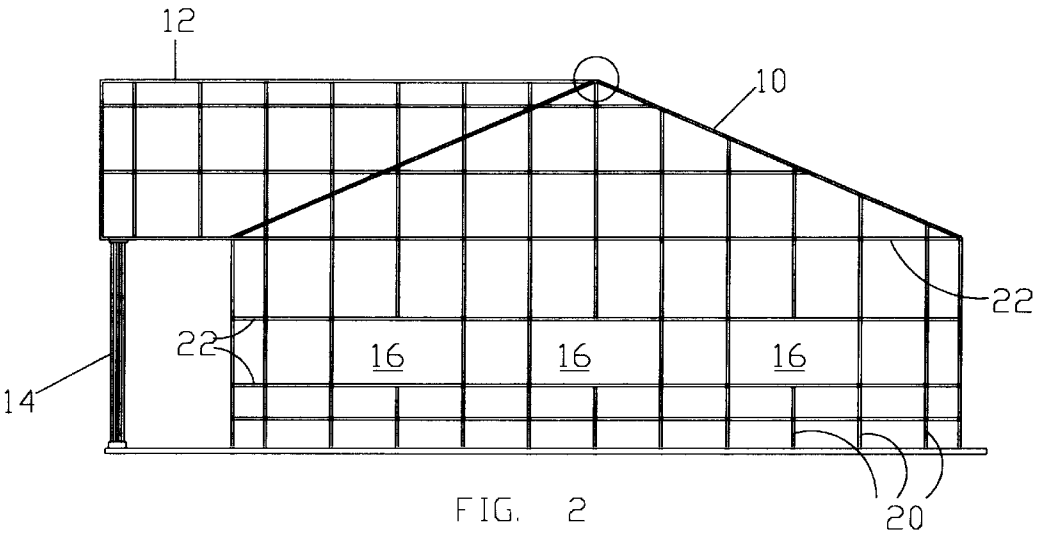
FIG. 2 is an end elevation of the FIG. 1 structure.
Figure 7:
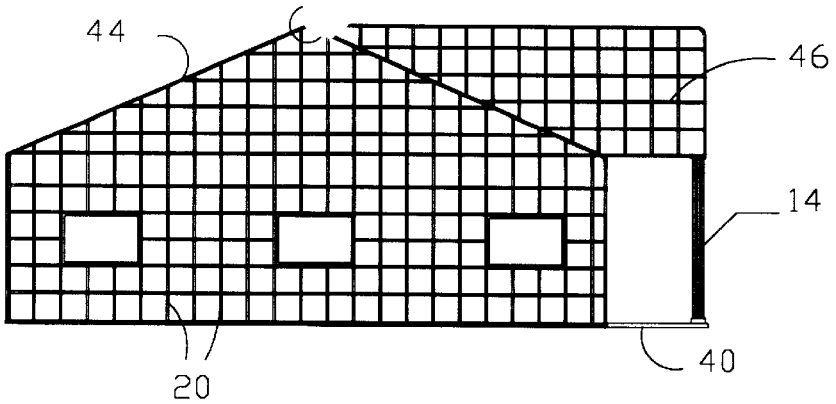
FIG. 7 represents the roof construction of the invention.
Figure 6:
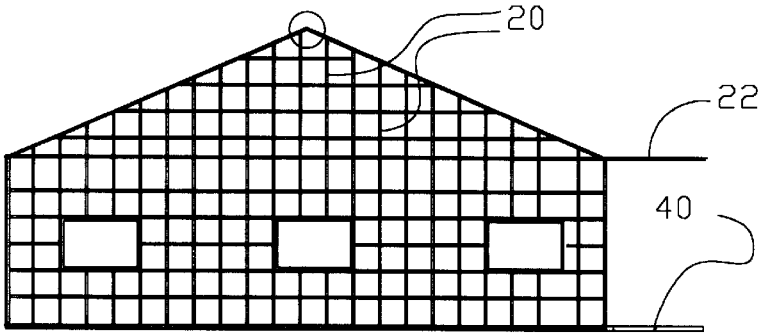
FIG. 6 represents the completed end wall matrix of the invention.

Relative to the drawings wherein like reference characters designate like or similar elements throughout the several figures of the drawings, FIGS. 1 and 2 illustrate a traditional western style rectangular structure 10 having a covered porch 12 along the entire front length dimension. The porch roof overhang is supported by columns 14. Windows 16 and doors 18 are openings in the vertical load bearing wall panels. Additional load bearing panels for support of roof, floor and ceiling loads are positioned internally of the outer walls. These load bearing walls and panels are constructed as substantially uniform, orthogonal distributions of vertical and horizontal structural tube elements, 20 and 22, respectively. The preferred cross-sectional geometry of such transversely intersecting tube elements 20 and 22 is circular. However, the invention features may be readily adapted for other cross-sectional shapes such as square or rectangular. As tubes, the cross-sectional geometry of elements such as 20 and 22 comprises a relatively thin perimeter wall about an internal void space. Definitively, a "tube", as the term is applied to this invention, is not a structural member having a solid material cross-section. In the case of a circular tube 20 or 22 for the present invention, the perimeter wall cross-section is substantially annular, e.g. the material substance of the tube wall occupies the space between substantially concentric inside and outside circular diameters.

Another characteristic of the tube elements 20 and 22 is that both elements of a transversely intersecting group are preferably of the same transverse sectional dimension. Simply stated, all of the tube elements 20 and 22 in a structure are of the same size and shape. For example, circular tubes 20 and 22 preferably have the same outside dimension and the same inside diameter dimension.

It will be appreciated that a load bearing panel must also include a defining or delineating perimeter whereat the panel is joined to one or more other panels. In the case of a wall, for example, the panel perimeter may include a floor perimeter line, a ceiling perimeter line and usually a vertical corner perimeter line. Accordingly, a group of parallel tube elements 20 or 22 will be secured, at least at one end thereof, at substantially uniform separation increments along a perimeter line common to the respective group. Hence, the plane and shape of a load bearing panel is substantially defined by at least a pair of mutually intersecting perimeter lines.

Figure 14:
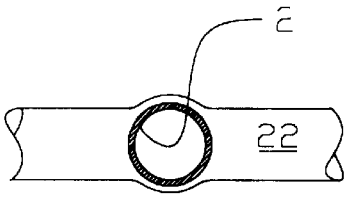
FIG. 14 illustrates the plan view of the FIG. 13 intersection.
Figure 13:
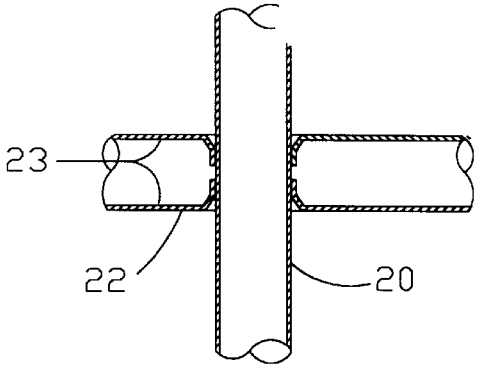
FIG. 13 illustrates the sectioned elevation of a punctured tube intersection of the invention.

From the perimeter line of structural attachment, longitudinal or axial extensions of the structural tube elements 20 and 22 make a matrix of substantially coplanar intersections of the tubular axes without a rigid connection therebetween. The respective tubes may slide from these intersection points at least along one axis, without a structural failure of the joint: albeit, such sliding is attended by considerable friction. FIGS. 13 and 14 illustrate one embodiment of such a joint wherein a receptacle tube of the intersection, in the horizontal run 22, for example, is penetrated by the continuous cooperative tube 20. Since both tubes are of substantially the same outside diameter, the girth of the receptacle tube 22 must be expanded to accommodate the penetrant 20. Preferably, the receptacle aperture is formed by mechanical puncture as distinguished from boring. Boring forms the aperture by material removal. Puncture, on the other hand, forms the receptacle aperture by piercing and stretching the tube wall material away from the aperture axis. Puncture apertures are formed by sharply pointed punch tools having an outside diameter shank of the desired aperture diameter. Advancement of the punch tool through the wall of tube 22 stretches and rolls tube wall material from the punch path into a friction flange 23. At the same time, the inside diameter of the receptacle tube 22 is stretched in a direction transverse to the penetrant tube 20 axis. Accordingly, the receptacle tube 22 outside diameter is deformed to bulge around the penetrant tube 20 by the approximately tube wall thickness on diametrically opposite sides.

Figure 16:
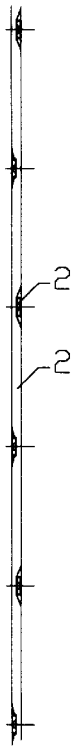
FIG. 16 illustrates the end elevational view of the woven wall matrix.
Figure 15:
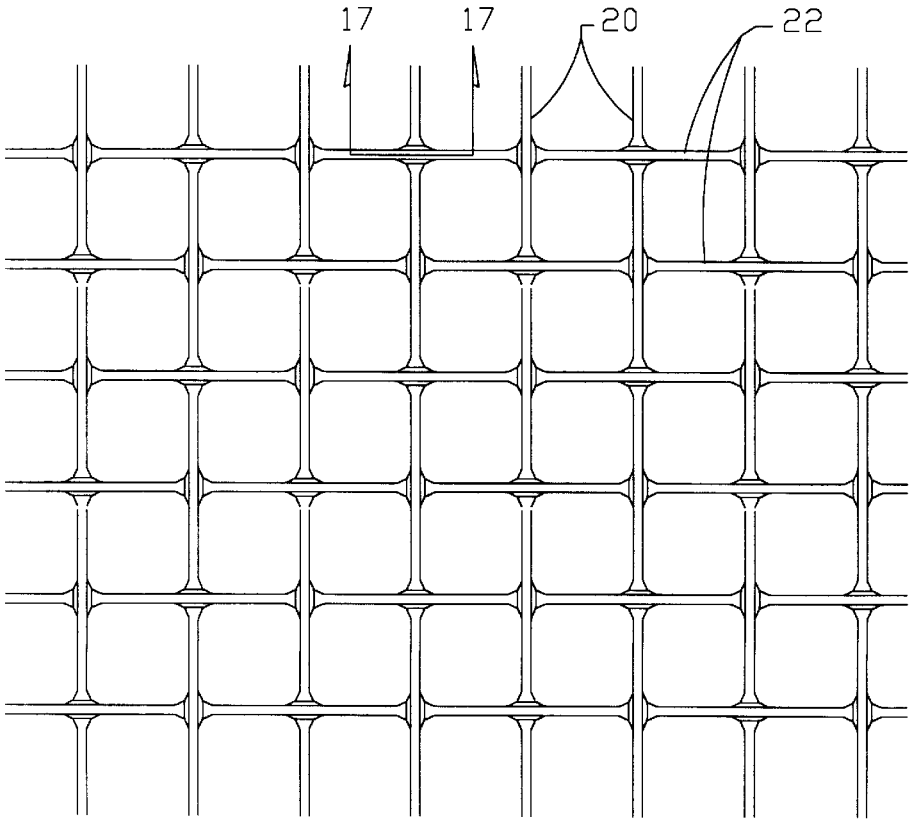
FIG. 15 illustrates the front elevational view of a woven wall matrix of the invention.

As another form of matrix intersection joint consistent with the objectives of this invention, FIGS. 15 and 16 illustrate a woven wall, roof or floor load panel of circular cross-section stringers 20 and longerous 22. There stringers and longerons are, for example, round, thin-wall, architectural steel tubing of 2 in. nominal diameter. Both, stringers and longerons are formed to a saddle profile 26 (FIG. 17) at each matrix intersection. Along each tube element, the saddle seat surfaces 27 are sequentially turned in oppositely facing directions. This alternating saddle seat orientation sequence of one element is orthogonally coordinated with the cooperative tube elements also having alternately facing saddle seats 27. In mutual assembly after the manner of a simple basketweave, the saddle socket 29 of one element is detent confined within the saddle socket 29 of the cooperative element.

These intersecting saddles may be field formed with relatively light weight hydraulic forming equipment. Preferably, however, such alternating saddle shapes are formed on continuous production equipment that automatically maintains the spacing and orientation of all saddles in a tube length.

Figure 18:
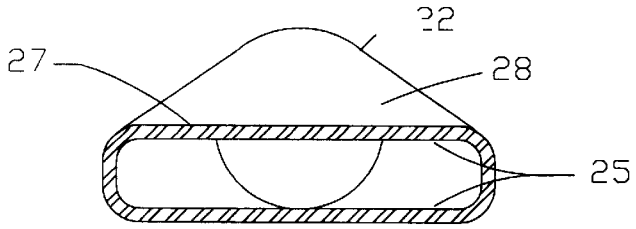
FIG. 18 is a sectional view of the saddle joint along cut plane 18—18 of FIG. 17.
Figure 19:
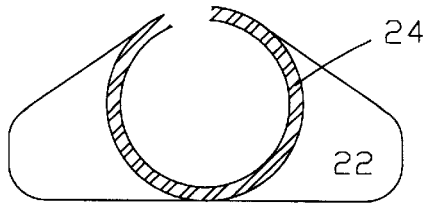
FIG. 19 is a sectional view of the saddle joint along cut plane 19—19 of FIG. 17.
Figure 17:
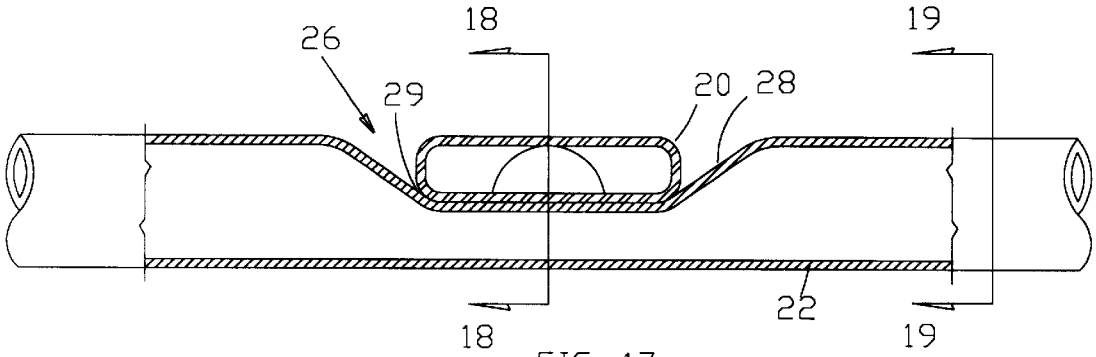
FIG. 17 is a sectioned view of an intersecting saddle joint.

With particular reference to FIGS. 17, 18 and 19, each saddle 26 is shown to include a flattened seat surface 27 that is essentially square having an axial length dimension corresponding to a traverse width dimension. Broadly, the circular perimeter of a tube wall is reconfigured to a rectangular prism having a depth that is substantially equal to the outside radius of the undistorted tube circle. Shoulders 29 axially delineate the seat surface 27 to restrain the cooperative saddle seated therewith. From the outer elements of the tubes, a tube ramp face 28 adjacent each shoulder 27 funnels a cooperative saddle into an appropriate intersection and confines it there without the rigid, unyielding attachment of rivets, bolts or welds, for example. Even when a pair of saddles is separated, the statically standing, stable bias of the assembly is a return to the preferred, mutually clasping alignment.

Figure 9:
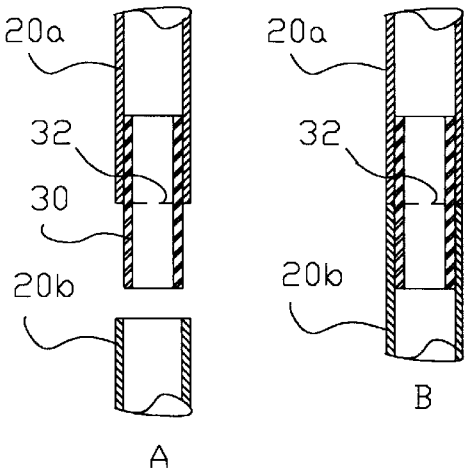
FIG. 9 illustrates the sequence of a tube lap splice.

As primary structural elements of the present invention, a length of preformed tubing may be selectively trimmed in the traditional manner of sawing or roll cutting. Unconventionally, however, thin wall steel tubing may be axially extended by means of an internal lap splice joint in the manner of FIG. 9. With the objective of axially extending the length of tubing joint 20*a*, the end of a metallic joint 20*a* is heated by means of a portable torch or furnace to enlarge the tubing inside diameter. While the end of tube 20*a* is hot, approximately half of a lap splice pin 30, at ambient temperature, is inserted coaxially into the open-ended bore of the tube-end. When cooled, the internal bore surface of the tube end shrinks upon the external surface of the pin 30 for a constrictive, interference fit therebetween.

Free dimensions at ambient temperatures will necessitate an inside diameter of the tube end 20*a* that is less than the outside diameter of the splice pin 30. In assembly, such a dimensional relationship is characterized as an interference fit. Both elements of the joint thermally stabilize to respective states of prestress with the tube 20*a* in tensile hoop stress and the pin 30 in compressive hoop stress. Preferably, such stress is substantially balanced. Control over the degree of stress in the respective elements is predominately controlled by the percentage of diameter differential. A standardized interference fit stress calls for an inside interference diameter difference of 0.6 of 1.0% and an outside interference diameter of 0.1 of 1.0%. Assuming a 2 in. ambient interference fit diameter, the ambient inside diameter of the tube 20*a* end may be for example:

$$2\text{ in.}-(2\text{ in.}\times 0.006)=2-0.012=1.988\text{ in.}$$

A corresponding ambient outside diameter for the pin 30 may be:

$$2\text{ in.}+(2\text{ in.}\times 0.001)=2+0.002=2.002\text{ in.}$$

In total, therefore, the interference fit differential is $$2.002\text{ in.}-1.988\text{ in.}=0.014\text{ in.}$$

Interference fit dimensions may be established for 0.002 to 0.015 in. interference differentials.

Duplicating the foregoing assembly of tube 20*a* with pin 30, tubing element 20*b* is heated and quickly pushed upon the projecting half of lap pin 30. Preferably, the two tube ends 20*a* and 20*b* are pushed into coaxially abutting union as at joint 32 of FIG. 9B. A conservative empirical lapping dimension could be a pin 30 axial penetration depth into the ends of tubes 20*a* and 20*b* of about three to four pin diameters.

Although the preferred embodiment of my invention utilize a heated interference fit as described for steel, ferrous alloys, aluminum, brass and other metallic tube forming materials, other coaxial joint techniques may be satisfactorily employed. For example, a slip fit joint of fiberglass and plastic tubing as well as metallic tubing may be axially secured by polymer bonding agents such as epoxies and polyester resins. Also, an axial slip fit joint of metallic tubing may be positionally secured after assembly by staking or beading. Staking is a procedure whereby a dull pointed tool is struck against the outer element wall of a coaxial assembly to dimple the outer wall into the inner wall. Depending on the degree of security required between the two coaxial elements, numerous dimples may be struck around the tube perimeter.

Beading may be considered a circumferentially continuous form of staking whereby a circumferential bead is rolled into the outer assembly element wall of such depth as to form a radially aligned bead into the wall of the inner assembly element.

Coaxial joints may also be secured by tapered pin and socket assembly whereby an internal surface of a tube socket is formed with a smooth, low angle, tapered face. Five degree or less taper angles have been used. A corresponding taper angled surface on the pin element of an assembly is mated into the socket.

Figure 11:
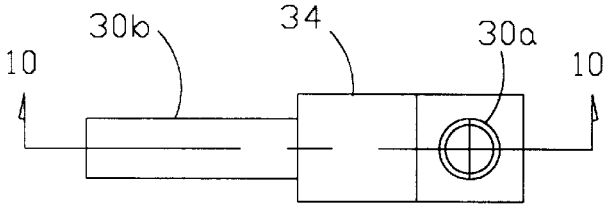
FIG. 11 illustrates the plan of the intersection joint of FIG. 10.
Figure 12:
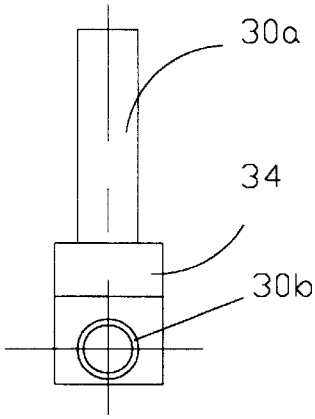
FIG. 12 illustrates the end elevation of the intersection joint of FIG. 10.
Figure 10:
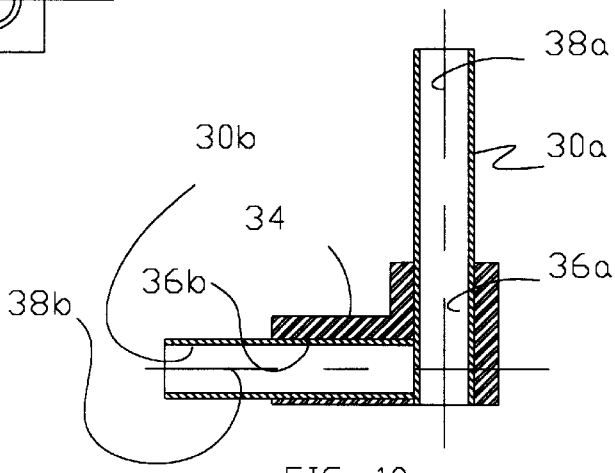
FIG. 10 illustrates the sectioned elevation of a 90° intersection joint for the invention.

There are numerous construction circumstances that require abrupt 90° planar intersections. The present invention construction system provides appliances of FIGS. 10, 11 and 12 based upon an elbow block 34 having bores 36*a* and 36*b* with mutually perpendicular axes 38*a* and 38*b*, respectively. Lap splice pins 30*a* and 30*b* are interference fit to the respective bores. To the lap splice pins 30*a* and 30*b*, panel tubes 20 or 22 are secured by interference fit.

This same principle of an elbow block may be further developed to additional configurations not illustrated such as a tee having a lap splicing length of lap pin 30*a* projecting from booth axial ends of bore 36*a*.

Figure 8:
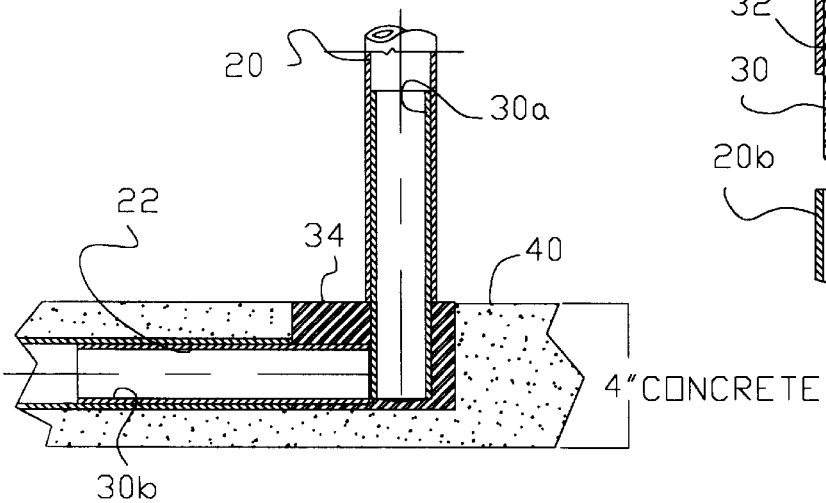
FIG. 8 represents a foundation section for the invention.

Those of ordinary skill in the art will recognize that the construction principles embodied in the elbow block and lap pin corner assembly appliance may be expanded to include axial projections in 3, 4, 5 and 6 directions. A particular application of the appliance is illustrated by FIG. 8 as a foundation interface for the shelter superstructure. Lap pins 30*a* and 30*b* are interference fitted to a common elbow block 34. The projected ends of the lap pins receive and secure the lower ends of vertical tubes 20 along a first, vertical plane and the ends of slab panel tubes 22 in the horizontal plane. The horizontal plane including a multiplicity of parallel aligned horizontal tubes 22 is cast in concrete for a reinforced slab 40.

Figure 4:
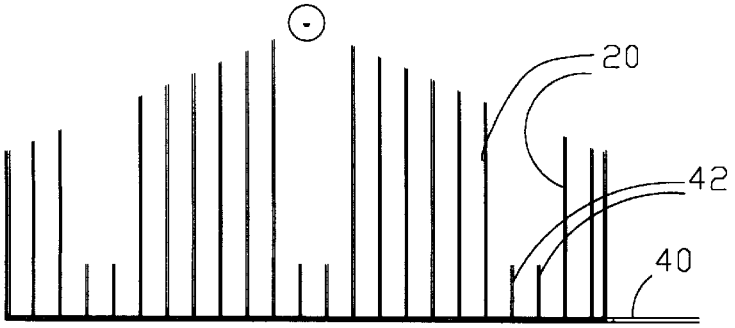
FIG. 4 represents the vertical tube erection in a construction sequence.
Figure 3:
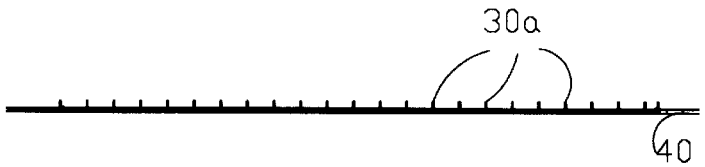
FIG. 3 represents the foundation of a construction sequence.

With reference to the construction sequence of FIGS. 3 through 7, FIG. 3 illustrates a foundation slab 40 from which vertical lap pins 30*a* project along the lines of the load bearing vertical walls and partitions. FIG. 4 illustrates the vertical tubes 20 to form an outside load bearing wall erected over the lap pins 30*a* in free-standing, vertical alignment. At positions along the wall corresponding to the location of windows and doors in the wall panels, the vertical tubes 30*a* are shortened as those represented by 42 or eliminated.

Figure 5:
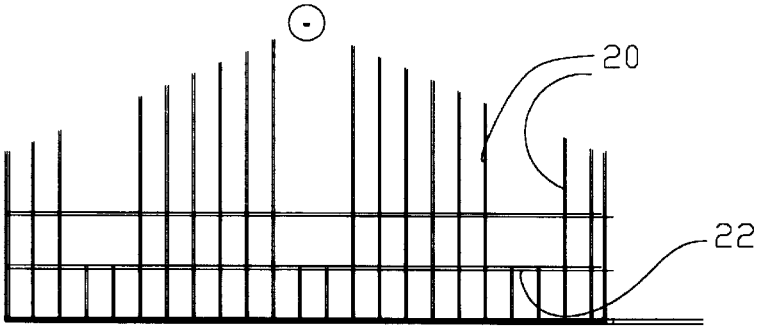
FIG. 5 represents the positionment of horizontal tubes in the construction sequence.

Referring to FIG. 5, the horizontal tubes 22 are matrix mated to the vertical tubes 20. In the case of a penetrated intersection matrix as shown by FIG. 14, a single horizontal tube length 22 may include several penetration points to be mated by an overlay procedure with corresponding vertical tubes 20. For convenience, the vertical tubes 20 may be extended axially by relatively short sections jointed by lap pins 30. As a section of vertical tube is extended, lengths of punctured horizontal tube 22 are impaled upon the free-standing vertical joints.

A woven intersection matrix as represented by the clasp saddle intersections of FIGS. 15 through 19, may be constructed with the vertical tubes erected to their upper terminus. Appropriate care should be taken, however, to horizontally align the adjacent saddles 26.

The assembly components illustrated by FIGS. 22 through 29 are constituents of a first panel joint embodiment whereby the planar intersections of different panels are secured together along the common perimeter line. For example, corner tube 60 may be temporarily secured along a line of intersection 68 common to panels that include horizontal tubes 22*a* and 22*b*, respectively. The distal ends of the tubes 22*a* telescopically receive, with a sliding fit, shanks 64 respective to a yoke joint 62. Rigidly integral with each yoke joint 62 are a pair of collars 66. The collars 66 are internally bored to a diameter corresponding to a slip fit around the outside diameter of the corner tube 60. Set screws not shown are turned through the collars 66 into the corner tube 60 to secure an axial location thereon.

Eye joints 70 also have a shank 72 sized for a telescopically sliding fit into the end of a panel tube 22*b*. The eye 74 of the joint is also bored to a sliding fit over the outside diameter of the corner tube 60. The width of the eye 74 is also coordinated to the gap between the yoke collars 66 for caged confinement therebetween when in mutual embracement around the corner tube 60. If desired, the eye joint could also be secured to an axial position along the corner tube 60 by set screws not shown.

Although the yoke and eye joints are secured to axial positions along the corner tube 60, the individual horizontal tubes 22*a* and 2*a* are given compliance from the corner tube 60 along the horizontal axis.

A second panel joint embodiment of the invention is represented by FIGS. 30 through 35 and comprises clevis joints 80 and 90. The clevis yoke joint 80 includes a sleeve 82 with a slip fit internal bore for telescopic receipt of a tubing 22*a* end. A pair of clevis yokes 84 extend rigidly from the sleeve 82. The clevis tongue joint 90 comprises a sleeve 92 having a sliding fit bore to receive the end of tubing 22*b*. From the sleeve 92, a clevis tongue 94 is projected with a width corresponding to the gap between the yokes 84. Both the yokes 84 and the tongue 94 have cooperative pin bores to receive a common fastener therethrough such as a pin or bolt shank.

As the matrix grows vertically, window and door frames are positioned and secured by traditional means and procedures. Matrix tubing upper ends are terminated by appropriate elbow blocks 34 into either roof rafters 44 or stringers 46. The potential for extremely rapid construction progress using the above described erection system will be apparent to those of ordinary skill in the art. Common construction materials such as low carbon steel are substantially stable dimensionally over temperate climatic conditions. Consequently, well known prefabrication techniques permit considerable off-site material cutting and forming without concern for humidity changes.

At the construction site, large numbers of tubing ends may be simultaneously heated in portable furnaces and selectively withdrawn for socketing upon a corresponding pin 30*a*. It is necessary to plumb only a select few of the vertical "studs" 20 due to the resilient nature of the material. The ordered spacing of the matrix intersections on the horizontal longerons 22 tends to correct any vertical misalignments relative to the plumbed tube element 20.

Figure 20:
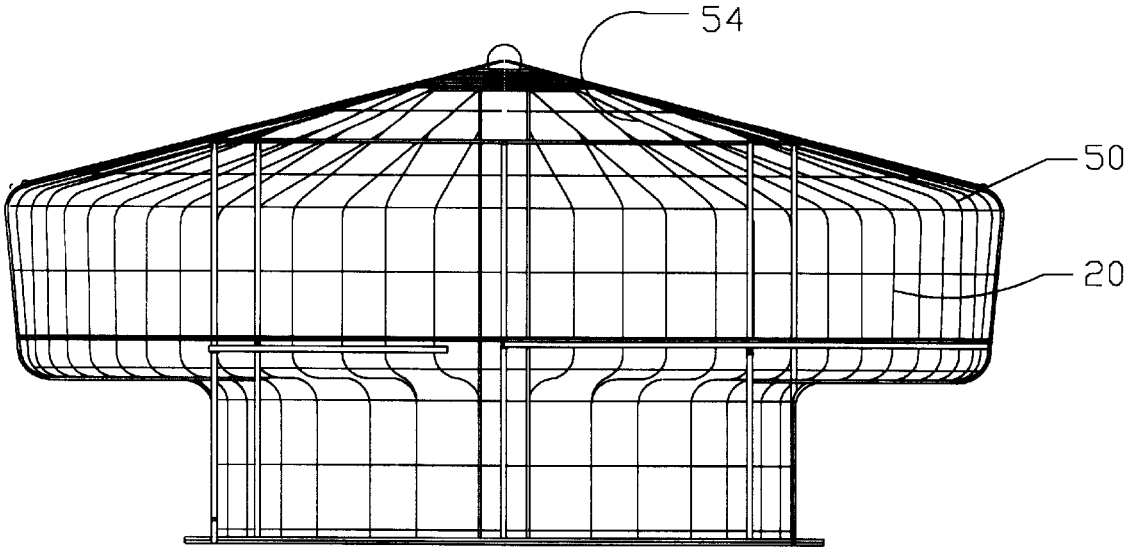
FIG. 20 is an elevational view of a circular plan structure according to the invention.
Figure 21:
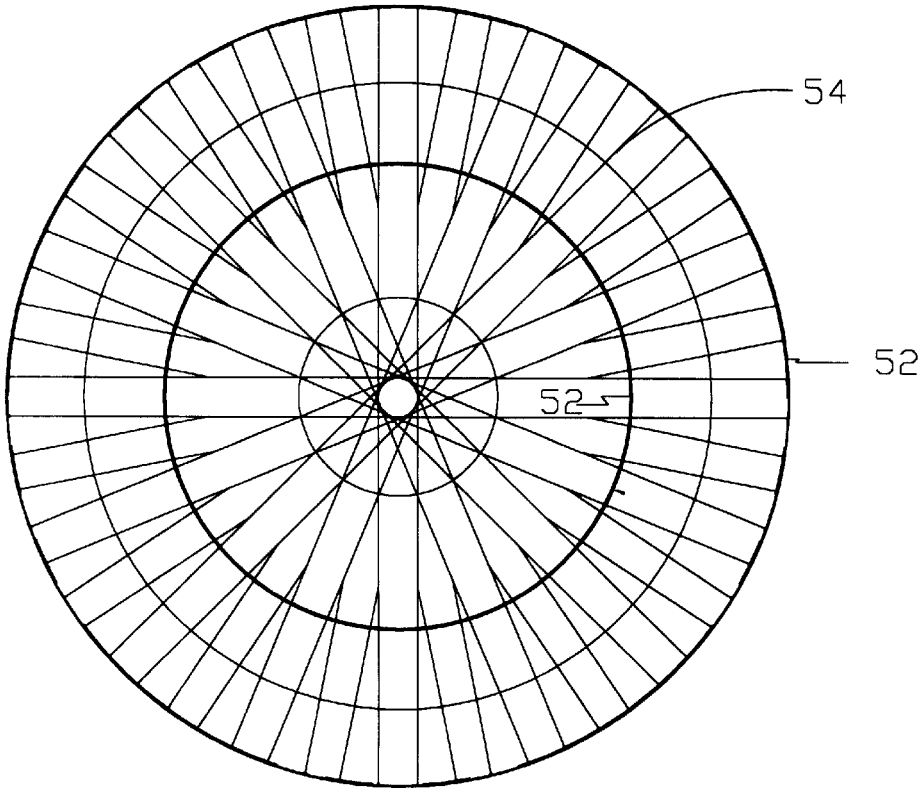
FIG. 21 is a plan view of the circular structure of FIG. 20.
Figure 22:
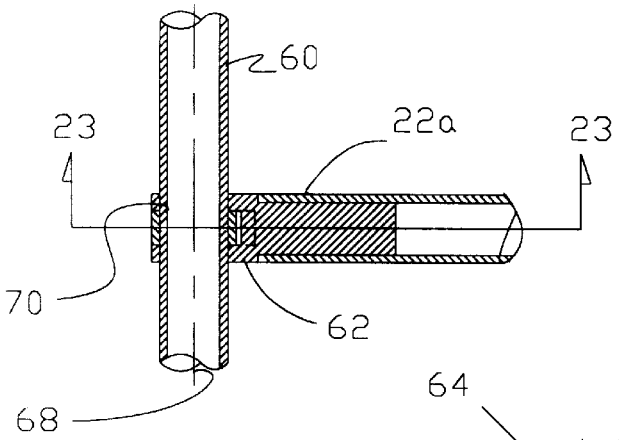
FIG. 22 is a sectional elevation of a yoke joint as viewed along cutting plane 2—2 of FIG. 23.
Figure 24:
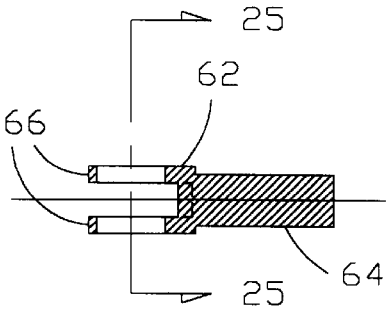
FIG. 24 is a side elevational view of a joint yoke.
Figure 25:
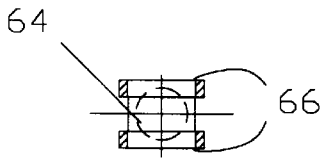
FIG. 25 is an end elevational view of a yoke element.
Figure 23:
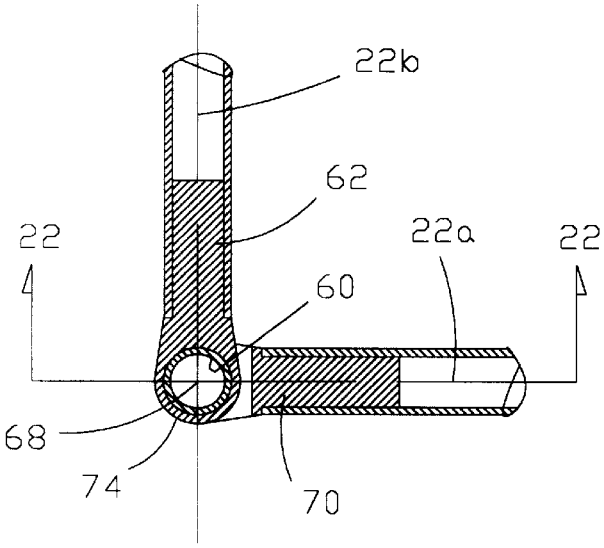
FIG. 23 is a sectional plan of a yoke point as viewed along cutting plane 3—3 of FIG. 22.
Figure 26:
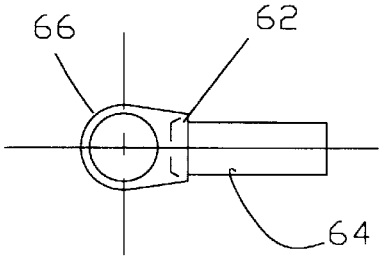
FIG. 26 is a plan view of a yoke element.
Figure 27:
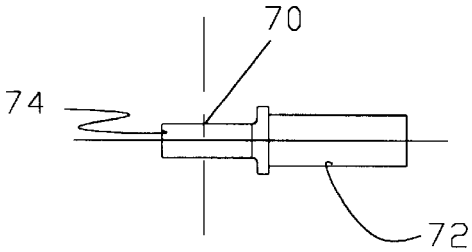
FIG. 27 is a side elevational view of an eye element.
Figure 28:
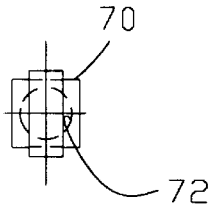
FIG. 28 is an end elevational view of an eye element.
Figure 29:
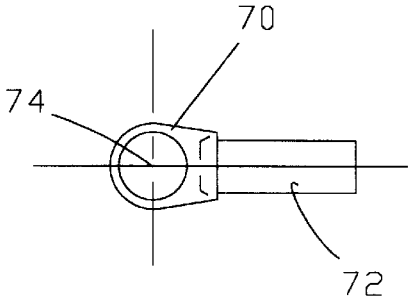
FIG. 29 is a plan view of an eye element.
Figure 38:
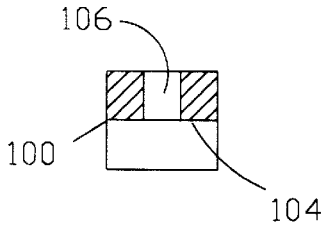
Figure 37:
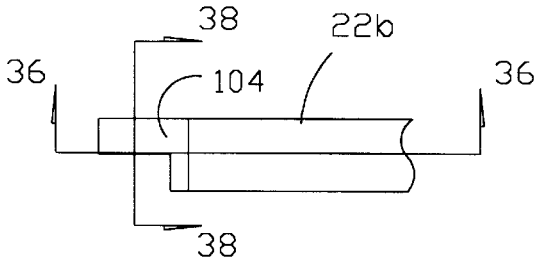
Figure 36:
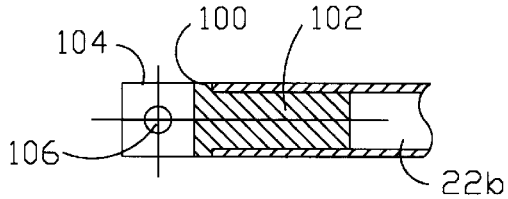
Figure 34:
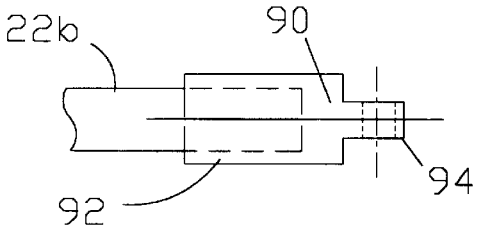
FIG. 34 is a plan view of a tongue element.
Figure 35:
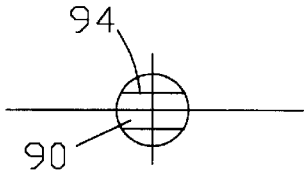
FIG. 35 is an end view of a tongue element.
Figure 33:
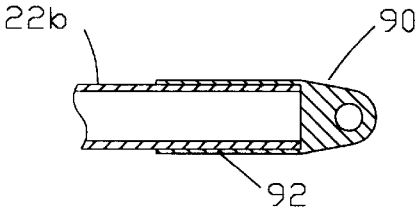
FIG. 33 is a sectional elevation of tongue element.
Figure 31:
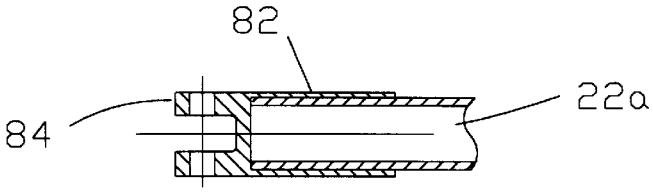
FIG. 31 is a plan view of a clevis element.
Figure 32:
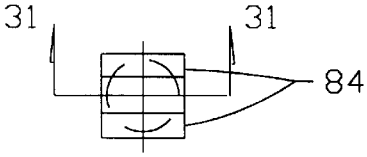
FIG. 32 is an end view of a clevis element.
Figure 30:
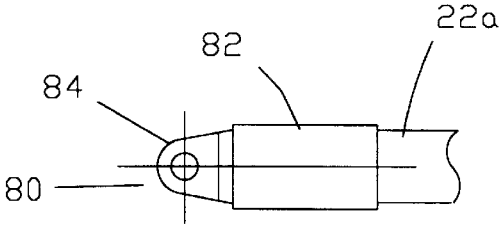
FIG. 30 is a sectional elevation of a joint clevis as viewed along cutting plane 4—4 of FIG. 31.

The shelter of FIGS. 20 and 21 is constructed to a circular plan form having no inside or outside corners. In lieu of elbow blocks 34, short radius bends 50 are formed in short lengths of tubing and arced in a hydraulically powered tubing bending machine. Lap pins 30 are inserted in both ends of the tubing arc to axially add length extensions from the bend 50. Horizontal ring tubes 52 may be joined with the riser tubes 20 and rafter tubes 54 by either the punctured apertures of FIG. 13 or the clasp saddle means of FIG. 17.

The foregoing description of my invention has been of a structural skeleton assembly. Those of ordinary skill in the art, however, will understand that most if not all traditional enclosure materials such as brick stone, wood and plaster may be integrated with the present invention by means of appropriate ties and/or clamps to the structural tubing. In doing so, however, due consideration should be given to the structural properties and characteristics of the facade material. For example, brick ties between a tube wall of the present invention and a veneer wall of brick are of poor risk for holding the brick facade together during a major earthquake. Conversely, exterior plaster secured by metal lathing at densely distributed tie points represents a wall that will maintain its essential structural integrity notwithstanding cracking and small particle dislodgment.

Having fully disclosed my invention, those of ordinary skill in the art will perceive obvious variations and alternatives to combine with the invention.

As my invention, however, I claim:

1. A method of constructing habitable structures comprising a plurality of load bearing panels, each panel being delineated within a perimeter defined by a plurality of perimeter lines, respective to a first load bearing panel, said construction method including the steps of: securing a first line of parallel aligned tubing elements at least at one end thereof and at substantially uniform increments of separation therebetween along a first perimeter line length for said first load bearing panel, securing a second line of parallel aligned tubing elements at least at one end thereof and at substantially uniform separation increments along a second perimeter line length for said first load bearing panel whereby length extensions of said second line of tubing elements meet transversely at points of intersection with length extensions of said first line of tubing elements, said tubing elements in said first and second perimeter lines having substantially the same transverse sectional geometry and dimension with a relatively thin wall structure, tubing element wall structure corresponding to said first line of tubing elements being structurally deformed at substantially uniformly separated positions along the length extensions thereof corresponding to said points of intersection, said second line of tubing elements being secured to said first line of tubing elements at said points of intersection by frictional engagement without the use of mechanical fasteners or adhesives whereby said tubing elements may be nondestructively displaced from and returned to said points of intersection along a length direction of at least one of such intersecting tubing elements without structural failure of a tubing element.

2. A method as described by claim 1 wherein the tubing element wall structure respective to said first line of tubing elements is formed at respective points of intersection to possess a greater transverse dimension than the corresponding transverse dimension of tubing element wall structure in said second line of tubing elements, said deformed tubing element wall structure having punctured apertures along axes substantially perpendicular to said one transverse sectional dimension, said apertures being penetrated by tubing elements respective to said second line of tubing elements with a sliding friction fit therebetween.

3. A method as described by claim 1 wherein tubing element wall structure respective to tubing elements in both of said first and second tubing element lines are cooperatively deformed at said points of intersection to clasp the other.

4. A method as described by claim 3 wherein said tubing element wall structure is deformed at said points of intersection to mutually engaging saddle profiles.

5. A method as described by claim 4 wherein saddle deformations are formed with alternately facing seat portions along a tubing element length.

6. A method as described by claim 1 wherein lengths of said tubing elements are axially extended by lap splicing pins.

7. A method as described by claim 6 wherein outside diameter surfaces of said lap splicing pins coaxially engage internal diameter surfaces of said tubing elements.

8. A method as described by claim 7 wherein unstressed outside diameters of said lap splicing pins are greater at the same temperature than unstressed inside diameters of said tubing elements.

9. A method as described by claim 8 wherein end portions of said tubing elements are heated to enlarge said inside diameter dimensions and said pins are partially inserted axially therein while said tubing elements are hot.

10. A method as described by claim 1 including the steps of setting anchor blocks in a castable foundation material at said substantially uniform increments along said first perimeter line, said anchor blocks having splice pins projecting up from a surface of said foundation, said splice pins coaxially receiving said tubing elements thereabout with an interference fitting relationship.

11. A method as described by claim 10 wherein at least two splice pins project from each of said anchor blocks along mutually perpendicular axial directions.

12. A method as described by claim 10 wherein a second of said splice pins is set within said castable foundation materials.

13. A method as described by claim 10 wherein said first perimeter line is curvilinear.

14. A method as described by claim 1 wherein at least one line of parallel aligned tubing elements are secured along the length of the corresponding perimeter line at substantially fixed separation increments and with sliding axial compliance transversely from said perimeter line.

15. A method as described by claim 14 wherein said corresponding perimeter line is common to a second load bearing panel.

16. A method as described by claim 15 wherein said corresponding perimeter line common to said first and second load bearing panels is formed by a length of tubing, each first panels tubing element secured to the common perimeter line tubing is telescopically assembled with a yoke collar.

17. A method as described by claim 16 wherein each second panel tubing element secured to the common perimeter line tubing is telescopically assembled with an eye collar, said eye collar being meshed with said yoke collar in mutual embracement of said common perimeter line tubing.

18. A method as described by claim 15 wherein each first panel tubing element secured to said common perimeter line is telescopically assembled with a clevis joint and each second panel tubing element secured to said common perimeter line is telescopically assembled with a tongue joint, said clevis joint and tongue joint being assembled by a common shear pin.

19. A habitable structure comprising a geometric assembly of load bearing panels comprising an assembly of relatively thin walled tubes; a first row of parallel aligned tubes secured at one end thereof and at substantially uniform separation increments along a first perimeter increment of a load bearing panel, tubes in said first row having substantially the same transverse sectional shape and dimension; a second row of parallel aligned tubes secured at one end thereof and at substantially uniform separation increments along a second perimeter increment of said load bearing panel whereby axial extensions of tubes in said second row meet at points of intersection with the axial extensions of tubes in said first row, tubes in said second row having substantially the same transverse sectional shape and dimension as tubes in said first row; said first row of parallel tubes being secured at points of intersection to the second row of parallel tubes without the use of mechanical fasteners or adhesives the walls of tubes in at least one of said rows being structurally deformed and at said points of intersection to accommodate a planar intersection of axes respective to said tubes and to enhance a frictional engagement between said tubes.

20. A structure as described by claim 19 wherein tubes in said first row penetrate the tubes in said second row through punched apertures in said second row tubes.

21. A structure as described by claim 19 wherein said tubes are deformed into saddle shapes at said intersection points, mutually engaging saddles at an intersection point having oppositely oriented seats.

22. A structure as described by claim 21 wherein the seats of successive saddles along the length of a tube are alternately oriented in oppositely facing directions.

23. A structure as described by claim 19 wherein said tubes are extended by lap splicing pins inserted axially within the tube walls of abutting tube ends.

24. A structure as described by claim 23 wherein said lap splicing pins have outside diameters that are dimensionally greater at ambient temperature than inside diameters respective to said abutting tube ends for an interference fit therebetween.

25. A structure as described by claim 24 wherein said abutting tube ends are heated to increase the respective tube inside diameters for partial length insertion of a respective lap splice pin.

* * * * *